United States Patent [19]

Nietupski

[11] 4,192,285

[45] Mar. 11, 1980

[54] AIR TIGHT FUEL BURNING STOVE

[75] Inventor: Val J. Nietupski, Michigan City, Ind.

[73] Assignee: Valco Corporation, Michigan City, Ind.

[21] Appl. No.: 853,529

[22] Filed: Nov. 21, 1977

[51] Int. Cl.[2] ..... F24C 15/28; F24C 1/08

[52] U.S. Cl. ..... 126/83; 126/75; 126/60

[58] Field of Search ..... 126/83, 77, 75, 60, 126/66

[56] References Cited

U.S. PATENT DOCUMENTS

| | | | |
|---|---|---|---|
| 63,885 | 4/1867 | Harris | 126/83 |
| 921,019 | 5/1909 | Speer | 126/83 |
| 921,481 | 5/1909 | Stombaugh | 126/83 |
| 989,358 | 4/1911 | Hemphill | 126/77 |
| 1,305,764 | 6/1919 | Alwart | 126/77 |
| 1,497,049 | 6/1924 | Walter | 126/77 |
| 2,257,931 | 10/1941 | Alexander | 126/83 |
| 2,559,271 | 7/1951 | Baines | 126/77 |
| 2,564,713 | 8/1951 | Miles | 126/77 |

*Primary Examiner*—Bernard A. Gelak

*Attorney, Agent, or Firm*—Le Blanc, Nolan, Shur & Nies

[57] ABSTRACT

A fuel burning stove for holding and burning fuel to heat the surrounding atmosphere in a room where the stove is employed. The stove includes a fire box which supports the fuel and where the combustion is sustained. An air inlet is provided to the fire box allowing the inflow of air for combustion with the fuel. The air is preheated upon entry into the fire box for mixture with volatiles formed by the burning fuel directed toward the entering air by a baffle means to effect a secondary combustion. In addition, a movable damper cooperates with the baffle to direct volatiles toward the incoming heated air when the damper is in the closed position and to provide a more direct path to the chimney when in the open position.

7 Claims, 3 Drawing Figures

AIR TIGHT FUEL BURNING STOVE

BACKGROUND OF THE INVENTION

The use of wood-burning stoves and other similar fuel-burning stoves which rely on radiation and convection of the stove itself are well known and have often been used to heat various rooms in houses in lieu of or supplemental to other heating methods. Such stoves are becoming more in vogue in view of the continually increasing costs for running more sophisticated centralized heating systems relying on oil or electricity.

These stoves are typically metal and burn wood, coal or other similar fuel to raise the temperature of the metal sufficiently to radiate and convect heat throughout the room where the stove is employed. A door is provided on the front of the stove which allows access for adding fuel and removing the ashes or other debris after the fuel has been burned. In addition, the door usually has openings which enhance radiation from the stove and create a draft to provide air containing oxygen to ignite the fuel and maintain combustion within the stove.

These stoves have been characterized by many different designs and functions; however, most of these are relatively ineffective in maintaining sufficient combustion to burn all the fuel within the stove. Also, there are significant problems in initiating the fire within the stove because without proper drafting, smoke may be released into the room until complete ignition is achieved.

Although attempts have been made to overcome these problems, they have been largely ineffective. An example of approaches to achieve better combustion is the stove shown in the U.S. Pat. No. 1,607,101 to Savereid. The Savereid stove includes a baffle across the center of the stove between the fire and the chmney for baffling the smoke and gas to achieve a more uniform heating throughout the stove rather than having a large portion of the heat pass directly up the chimney. Another example is U.S. Pat. No. 704,331 to Howard which relates to a heating stove having a cast iron fire pot. Cold air enters the front part of the stove via a damper where it is divided into two flow paths. One flow path is upwardly through a grate disposed toward the front of the stove, and the other flow path extends rearwardly through the ash pit and upwardly through openings into the combustion chamber where it mixes with gases given off by the fuel to achieve so-called "perfect combustion". Other examples of stoves relating to damper arrangements for changing the flow path include the U.S. patents to Hughes et al U.S. Pat. No. 1,204,773; to Waters U.S. Pat. No. 728,527; and to Card U.S. Pat. No. 2,174,347.

The problem with these stoves in their attempt to create more efficient burning is their failure to achieve secondary combustion with new oxygen as it flows into the stove. In addition, these stoves often require rather complex and sophisticated entry and exit flow paths and related apparatus to achieve the necessary combustion. This, of course, raises the cost of manufacturing these stoves and detracts users from buying stoves which are rather complex in operation.

SUMMARY OF THE INVENTION

The invention described herein relates to a stove which achieves substantially complete combustion of the fuel used within the stove through a relatively simple and yet uniquely efficient stove apparatus. In addition, the stove includes means for preventing smoke from pouring out into the room during the ignition of the fuel at the beginning of the combustion process.

As described more specifically in the preferred embodiment, the invention includes a metal stove, having a baffle extending from the top of the stove downwardly towards the stove door located in the front of the stove for directing volatiles towards the door. The door of the stove is provided with draft openings for allowing air-containing oxygen to flow inwardly for use in combustion of the fuel contained in the bottom of the stove. A heat exchanger is incorporated with the door for preheating the incoming air. By directing these volatiles back toward the door, the preheated air will raise the temperature in the front portion of the stove sufficiently to ignite the volatiles which otherwise would be carried up the chimney.

The top of the stove has several outlet ducts; two in the front portion of the stove and one in the rear portion of the stove. These outlet ducts are connected by a cross plenum which also carries a damper for opening and closing the rear duct. The outlet chimney is connected in communication with the cross plenum directly above the rear outlet duct. In this way, when the damper is moved to a closed position, no air volatiles or other combustion products can flow out of the outlet in the rear of the stove. Rather, they will be directed via the baffle toward the front of the stove for secondary ignition and then upwardly through the front ducts into the plenum and out of the chimney at the rear of the plenum.

On the other hand, in achieving the ignition, it is desirable to obtain as much draft as possible and to avoid smoke pouring out through the draft openings in the front of the stove. By moving the damper to the open position increased draft will be achieved, through the more direct path resulting to the chimney through the outlet at the rear of the stove. As a result, the rather large amounts of smoke which typically form during the ignition process will be drafted out of the outlet directly to the chimney rather than through the convoluted path which is provided when the damper is in closed position. Once ignition and sustained combustion has been obtained, the damper is moved to the closed position allowing the volatile gases to be directed toward the front of the stove for secondary combustion resulting in more efficient burning of the fuel.

An object of the invention is to arrive at a more efficient fuel-burning stove which burns substantially all the fuel and avoids the complexities and high costs of manufacture which has characterized stoves of the past.

It is another object to provide a stove which creates secondary combustion for burning volatile gases formed from the primary fuel combustion to achieve substantial burning of all fuel.

It is a further object to include baffle means within the stove to direct the volatile gases from other portions of the stove toward preheated air flows into the front portion of the stove for use in the combustion process. This preheated air raises the temperature in the vicinity of the front portion of the stove sufficiently to cause combustion of the valatiles being directed to that area by the baffle means.

It is still another object of the invention to prevent smoke from flowing into the room where the stove is located during ignition when cumbustion is just being started.

It is still a further object of the invention to provide a damper apparatus which allows a draft to be created from the fuel directly to the chimney to avoid smoke pouring out into the room. This damper means includes moving the damper to another position where the direct path to the chimney is closed off once ignition has been achieved allowing a more convoluted path to be taken for secondary combustion.

DETAILED DESCRIPTION OF THE PREFERRED EMBODIMENT

Figure 1:
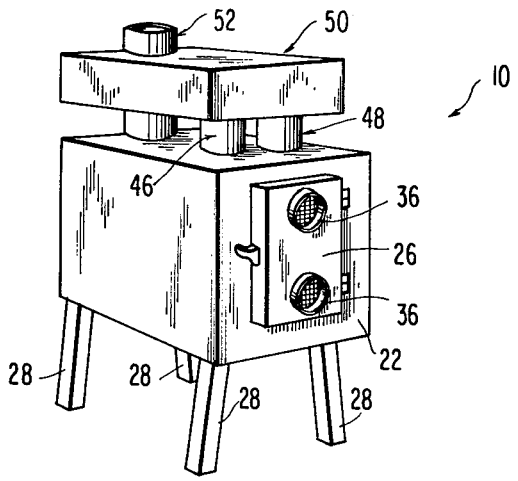
FIG. 1 is a perspective view of the stove.
Figure 2:
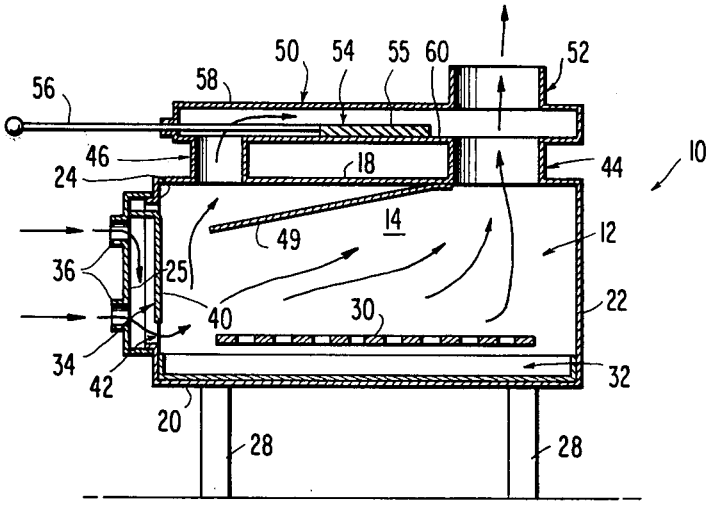
FIG. 2 is a cross section view of the stove taken along lines 2—2 of FIG. 1 with the damper in an open position.
Figure 3:
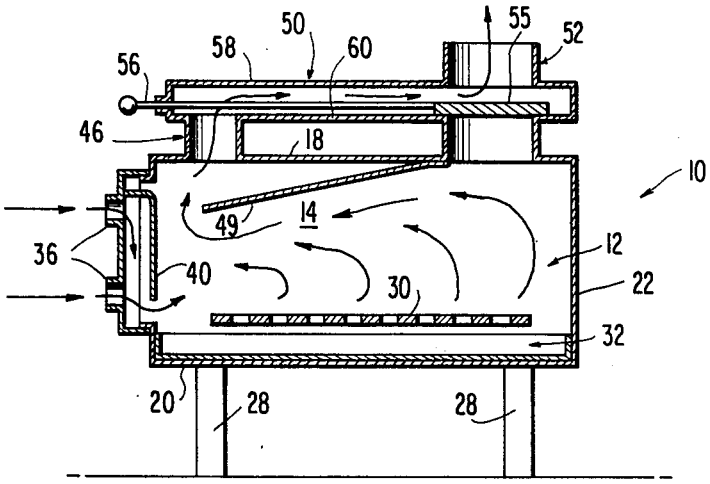
FIG. 3 is the cross-section view shown in FIG. 2 with the damper in the closed position.

The wood-burning stove is shown generally in perspective in FIG. 1. Details of the construction are shown in FIGS. 2 and 3 which should be referred to in connection with the following discussion.

The stove 10 is generally comprised of a firebox 12 having two side walls 14, 16, top wall 18, bottom 20, rear wall 22 and front wall 24. A door 26 is hingedly secured to the front wall 24 of the firebox 12 in any suitable manner to provide access to the inside of the firebox for fueling the stove and withdrawing ashes therefrom once the fuel has been burned. Four legs 28 extend from the bottom 20 for supporting the stove 10 at a sufficient distance from the floor to maximize radiation and heat transfer to the room where the stove will be used.

A grill 30 is supported above the bottom 20 to form with the buttom 20 an ash pit 32. The grill 30 supports the fuel being burned, which in this case are stacks of wood, and is located sufficiently above the ash pit so that draft air can pass upwardly through the grill for ignition combustion of the wood supported thereon. In addition, the ash pit 32 allows the ashes to build up underneath the grill 30 without interference with the draft and to provide an easy means for withdrawing the ashes once the fuel has been burned.

A heat exchanger 34 is secured to the interior side 25 of the door 26 for preheating air as it enters the firebox 12 for combustion with the fuel and for providing a means of transferring heat out of the firebox to the surrounding area. The heat exchanger 34 includes upper and lower draft ports 36, 38 provided on the front of the door 26. A metal box is secured to the rear portion of the door 36 which completely circumscribes the ports and has an opening 42 in the bottom of the box providing a path for incoming draft air through the ports to the firebox 12. Extending from the top 18 of the stove 10 is a rear outlet duct 44 located adjacent the rear wall 22 and two front outlet ducts 46, 48 located adjacent the front wall 24 all of which extend upwardly in a substantially vertical disposition from the top wall 18 of the stove 10. The front and rear outlet ducts 44,46,48 are connected by a cross plenum chamber 50 located above the top wall 18. Extending upwardly from the plenum chamber 50 is a chimney 52 whose center line is coextensive with the center line of the rear outlet duct 44.

The plenum chamber 50 has an upper wall 58 and a lower wall 60 for supporting a damper means 54 for opening and closing the rear outlet duct 44. The damper means includes a plate 55 in slidable relationship with the lower wall 60 for movement toward and away from the rear wall 22 of stove 10. A rod 56 extends from the plate 55 through the front of the plenum chamber 50 exposing the end of the rod to an operator to move the plate 55 between an open position to a closed position. In the open position, as shown in FIG. 1, the damper plate is completely withdrawn from the rear outlet duct 44 which results in an unobstructed path from the firebox 12 through the rear outlet duct 44 to the chimney 52. When moved to the closed position as shown in FIG. 3, the damper plate 55 completely closes off the rear outlet duct 44 leaving the only flow path out of the firebox through the front outlet ducts 46,48, through the plenum chamber 50 and out of the chimney 52. A baffle 49 extends from the top wall 18 of the firebox 12 downwardly toward the front wall 24 as shown in FIGS. 2 and 3. In this way, when the damper plate 55 is in a closed position, the air particularly in the rear portion of the firebox, will be forced toward the front wall 24 before finding its way out of the stove 10 through the front outlet ducts 46,48, the plenum chamber 50, and the chimney 42.

In operation, the fuel, which in this preferred embodiment is stacked on the grill 30 and ignited. The door 26 is then closed and the damper is moved to the open position providing an unimpaired flow path through the rear duct 44 to the chimney 52. This allows rapid circulation of air through the draft ports 36 and 38 about the grill and fuel and upwardly through the outlet duct and out of the chimney. Because of this increased circulation, smoke formed from unseasoned wood, or other types of fuel which may result in unusual amounts of smoke, is allowed to be quickly drawn out of the firebox through the chimney rather than being spewed out into the room through the ports 36 and 38. This allows quick starting of the fire as well as preventing smoke from being released into the room during start up and even after the fire has been well established.

Where smoke is not a problem, the damper plate 55 can be moved to a closed position of the firebox to the chimney 52. In this closed disposition the gases particularly in the rear portion of the firebox 12 are forced forwardly and downwardly to an area in the vicinity of the heat exchanger 34 before they can pass out of the stove 10 through the front outlet ducts 46 and 48 as described above. During the burning of the fuel, substantial amounts of valatile gases may be given off because of incomplete combustion. By directing these gases toward the heat exchanger as described above, these gases can mix with the incoming oxygen in the air through the draft ports causing ignition of the volatiles as secondary combustion. Because the incoming air passes through the heatexchanger, it is preheated to a temperature of about 1200° which is hot enough to ignite these volatiles and effect secondary combustion. As a result, additional heat is released through the front ports of the heat exchanger which further radiates into the room. This creates more efficient burning in that all the available fuel is used up from primary and secondary combustion and enhances the heat transfer out through the draft ports 36 and 38.

Thus, the stove described above is one which is relatively simple in configuration and operation and yet unique in its ability to utilize all the fuel in secondary and primary combustion. Further, ignition is enhanced by the ability to achieve increased circulation by simply moving a damper from a closed to an open position. This also prevents smoke from being released into the room should the fuel being used result in significant amounts of smoke.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced herein.

What is claimed is:

1. A stove for holding and burning fuel to heat the surrounding atmosphere in a room, said stove comprising:

a housing having a fire box for supporting the fuel to be burned, the fire box having front, rear, upper and lower portions;

air inlet means located in the front portion of the fire box communicating between the fire box and the surrounding atmosphere for providing a flow path for air into the fire box from the atmosphere for combination with the fuel;

heating means cooperating with said air inlet for heating said air entering said fire box;

baffle means secured within said housing and located relative to the rear portion of the fire box for directing at least a portion of the volatile gases given off by burning fuel toward said heating means from the rear portion to the front portion of the fire box to mix with incoming air and achieve secondary combustion, said baffle means including a baffle extending downwardly from the upper portion between said front portion and rear portion toward said front portion to direct volatile gases formed during burning of a fuel toward said front portion; and outlet means disposed in the upper portion of said fire box for cooperating with said baffle means and directing said volatile gases toward the front portion, said outlet means including a rear outlet duct and at least one forward outlet duct, a damper means for movement between an open position and a closed position, said damper means in said closed position substantially impeding flow out of said rear outlet duct, whereby in said closed position said volatile gases will be directed by said baffle toward said front portion and in said open position at least a portion of said volatile gases will pass directly out of said rear outlet duct.

2. The stove according to claim 1 further comprising a plenum chamber connecting said front outlet duct with said rear outlet duct, said plenum chamber having a chimney for providing an outlet therefrom, whereby when said damper is in said closed position, substantially all the gases within the stove pass out of the front ducts through the plenum chamber to the chimney and when said damper is in the open position at least a portion of said gases pass through the rear outlet duct through the chimney.

3. The stove according to claim 2 wherein said chimney is located adjacent the rear portion of said stove above said rear outlet duct for allowing gases in the rear portion of said stove to pass directly through the outlet duct to the chimney.

4. The stove according to claim 3 wherein said damper means includes a metal plate slidably secured within said plenum to completely cover said outlet duct in the closed position, said metal plate having a rod extending therefrom through one wall of the plenum chamber for exposure to an operator to move the plate from between the open position and the closed position.

5. The stove according to claim 4 further comprising a door providing access to said fire box, said door including an upper and lower draft port defining said air inlet means for allowing the introduction of air, said door having an exposed side and an interior side with a heat exchanger secured to said interior side of said door, said heat exchanger having an opening therein for allowing the air entering the heat exchanger through said draft ports to pass into said stove, said heat exchanger preheating the air entering through said ports before passing into the stove for raising the temperature in the vicinity of said heat exchanger sufficiently to cause secondary combustion with the volatile gases directed to the front portion of the stove by said baffle means when said damper is in said closed position.

6. A stove for holding and burning fuel to heat the surrounding atmosphere in a room, said stove comprising:

(a) a housing having a fire box for supporting fuel to be burned and sustaining the combustion of the fuel;

(b) air inlet means in communication between the fire box and the surrounding atmosphere to provide a flow path for air into the fire box from the atmosphere for combustion with the fuel;

(c) said fire box including a front portion and a rear portion, said air inlet means being located in the front portion and baffle means located relative to the rear portion for directing at least a portion of the volatile gases in the rear portion toward the front portion to mix with incoming air;

(d) said fire box further including an upper portion and a lower portion, said baffle means including a baffle extending downwardly from the upward portion between the front portion and rear portion toward the front portion to direct volatile gases formed during the burning of fuel toward the front portion;

(e) said stove and the upper portion of said fire box further including outlet means cooperating with said baffle means for conveying the volatile gases from said fire box said outlet means including, (i) a rear outlet duct and at least one forward outlet duct extending upwardly from said fire box, and damper means for movement between an open position and a closed position, said damper means in the closed position substantially impeding flow through said rear outlet duct and in said open position providing an unimpeded flow path through said outlet duct, (ii) a plenum chamber connecting said front outlet duct with said rear outlet duct, said plenum chamber having a chimney for providing an outlet therefrom, whereby when said damper means is in the closed position, substantially all the gases within the stove pass out of the front duct through the plenum chamber and the chimney and when said damper means is in the open position the gases pass through the rear outlet duct and the chimney, (iii) the chimney being located adjacent the rear portion of said fire box above said rear outlet duct for allowing gases in the rear portion of said stove to pass directly through the outlet duct to the chimney when said damper means is in the open position, (iv) damper means including a metal plate slidably secured within said plenum and adapted to completely cover said rear outlet duct in the closed position, said metal plate having a rod means extending therefrom through one wall of the plenum chamber for moving the plate between the open position and the closed position, (f) a door carried by said stove having an upper and a lower draft port defining said air inlet means, said door having an exposed side and an interior side, a heat exchanger secured to said interior side of said door, said heat exchanger having an opening therein for allowing the air entering the heat exchanger through said draft ports to pass into said stove, said heat exchanger adapted to preheat the air entering through said ports before passing into the stove for raising the temperature in the vicinity of said heat exchanger sufficiently to cause secondary combustion with the volatile gases directed to the front portion of the stove by said baffle when said damper is in said closed position.

7. The stove according to claim 6 wherein said heat exchanger includes a metal box secured to the interior portion of the door completely circumscribing said ports, said box having a bottom portion with an opening therethrough providing a path for incoming air.

* * * * *

UNITED STATES PATENT AND TRADEMARK OFFICE

CERTIFICATE OF CORRECTION

PATENT NO. : 4,192,285

DATED : March 11, 1980

INVENTOR(S) : VAL J. NIETUPSKI

It is certified that error appears in the above-identified patent and that said Letters Patent are hereby corrected as shown below:

Column 1, line 37, the word "chmney" should read ---chimney---

Column 2, line 65, the word "valatiles" should read ---volatiles---

Column 4, line 49, the word "valatile" should read ---volatiles---

Signed and Sealed this

*Tenth* Day of *June 1980*

[SEAL]

*Attest:*

SIDNEY A. DIAMOND

*Attesting Officer*

*Commissioner of Patents and Trademarks*